United States Patent [19]

McKay

[11] Patent Number: 4,468,822

[45] Date of Patent: Sep. 4, 1984

[54] SPA

[76] Inventor: Stewart K. McKay, P.O. Box 5022, Gold Coast Mail Centre, Queensland 4217, Australia

[21] Appl. No.: 468,906

[22] Filed: Feb. 23, 1983

[30] Foreign Application Priority Data

Feb. 23, 1982 [AU] Australia ..... PF2811

[51] Int. Cl.[3] ..... E04H 3/18

[52] U.S. Cl. ..... 4/488; 4/492; 4/496; 4/506; 128/66

[58] Field of Search ..... 4/492, 541, 542, 490, 4/496, 596, 608, 606, 615, 506, 489, 488; 128/66

[56] References Cited

U.S. PATENT DOCUMENTS

| | | | |
|---|---|---|---|
| 4,126,905 | 11/1978 | Russell et al. | 4/489 |
| 4,149,281 | 4/1979 | Bob et al. | 4/542 |
| 4,233,694 | 11/1980 | Janosko et al. | 4/542 |
| 4,339,833 | 7/1982 | Mandell | 4/541 X |
| 4,340,982 | 7/1982 | Hart et al. | 4/542 X |

*Primary Examiner*—Henry K. Artis

*Attorney, Agent, or Firm*—Sughrue, Mion, Zinn, Macpeak and Seas

[57] ABSTRACT

This invention relates to a spa which may be used in an in-ground or above ground swimming pool or other liquid containing structure.

The spa includes a frame capable of supporting a person or persons and comprising one or more frame members having a plurality of apertures or perforations. There is also included conveying means connectable to a liquid source such as the outlet pipe of a swimming pool for conveying liquid to the apertures or perforations included in the spa frame whereby liquid may be expelled under pressure of a person or persons supported by the frame.

Suitably there is also included aerating means associated with the conveying means for aerating liquid before being expelled from the apertures or perforations in the spa frame.

4 Claims, 7 Drawing Figures

SPA

This invention relates to an improved spa which may be utilized in an in-ground or above ground swimming pool or other liquid containing structures.

Hitherto spas comprising a plurality of jets of water supplied from a plurality of orifices in a suitable enclosure or housing have been very popular in assisting in achieving relaxation of a person bathing in the spa. Conventional spas have normally comprised a permanent installation in the swimming pool and normally were considered to be a relatively expensive item or an optional extra associated with the swimming pool.

It is therefore an object of the invention to provide an improved spa which is relatively inexpensive to produce and which is simple to operate.

The spa of the invention includes:

a spa frame capable of supporting a person or persons and comprising one or more frame members having a plurality of apertures or perforations, and conveying means connectable to a liquid source for conveying liquid to the apertures or perforations included in the spa frame whereby said liquid may be expelled under pressure on a person or persons supported by the frame.

The spa frame is preferably comprised of frame members which are tubular in shape and wherein the tubular members are round or circular in cross-section. Each frame member is suitably telescopically connected to each other and this may be achieved by the use of suitable joint members such as elbow joint members, T-shaped joint members and joint members in the shape of a V or U. Preferably each frame member includes a plurality of apertures or perforations located therewithin.

Preferably the spa frame in side view is V shaped or U shaped and as such may be utilized to support a lounging chair or lounging frame which may comprise a chaise tongue or "banana lounge" in some cases for supporting the person or persons.

Alternatively and more preferably the spa frame includes a support mat or mesh connected to the peripheral frame members of the spa frame. The mesh may be formed from a latticework of a plastic coated (e.g. PVC) wires or other cross linked members.

Suitably the spa frame is flexible and may be formed from frame members formed from plastics material such as PVC. In plan view the spa frame may be in the shape of a rectangle and include a pair of cross members intermediate the peripheral end members whereby each cross member is attached to each side member.

If desired there may also be included a support member for the spa frame which enables the spa frame to float in the liquid contained in the liquid containing structure.

The support member in one form may include a rectangular support frame preferably made from rigid material such as tubular members interconnected at the corners by joint members such as elbow joints. Preferably the tubular members are formed from rigid PVC. The elbow joints may be welded to each frame member of the rigid frame so as to seal the air completely within each frame member. However it will be appreciated that the support frame may adopt any other suitable configuration such as described hereinafter in the attached drawings.

There also may be aerating means for aerating the liquid (usually water) as it passes through the conveying means before passing into the internal dimensions of the spa frame.

The conveying means in its most preferred form is suitably a pipe or flexible conduit or it may confuse a plurality of pipes or conduits.

Suitably the aerating means comprises a jet tube or jet insert located within the conveying conduit having a restricted outlet orifice. In another form the aerating means could comprise a restricted portion of the conveying tube. Suitably located adjacent the restricted orifice or restricted outlet of the aerating means is one or more air conduits leading into the interior of the conveying conduit or conveying conduit end portion adjacent the spa frame. The aerating means operates by water passing through the restricted orifice or outlet whereby as it passes into an expanded or enlarged area beyond the restricted outlet or orifice there is caused a pressure differential to exist between both sides of the restricted orifice which draws air from the air conduit into the water stream. The resulting water entrained with air droplets or bubbles may then travel to the apertures or perforations in the spa frame.

More suitably the aerating means is housed within a valve assembly or housing connected to an adjacent end of the conveying tube which valve housing may be connected to flexible hoses which communicate with the spa frame.

Preferably the valve housing includes a rotary valve of any suitable type for shutting off the flow of water when required. If desired there may be incorporated two rotary valve members at opposite ends of the valve housing. In this latter embodiment there may be provided a pair of flexible hoses which may communicate with each of the above described cross members of the spa frame.

Reference may now be made to a preferred embodiment of the invention as shown in the accompanying drawings wherein.

Figure 1:
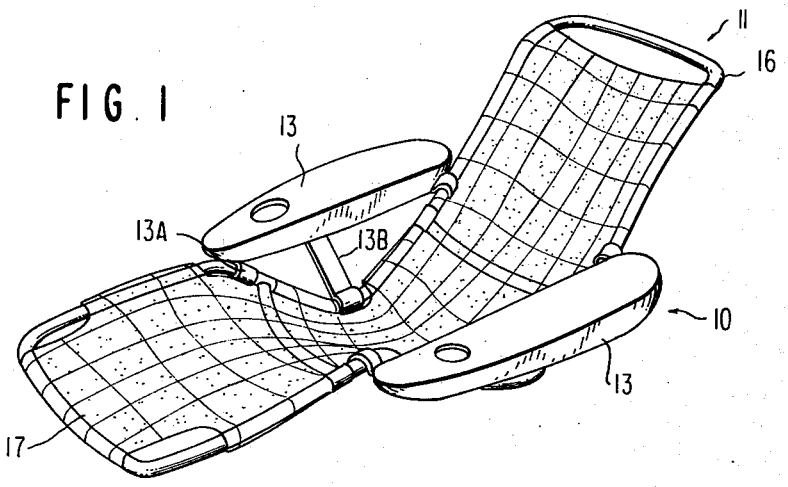
FIG. 1 is a perspective view of a spa constructed in accordance with the invention supported by a floatable support frame.
Figure 2:
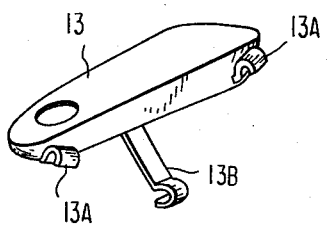
FIG. 2 is a perspective view of an armrest component of the floatable support frame.
Figure 3:
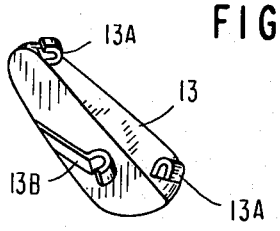
FIG. 3 is an alternative perspective view of the armrest component shown in FIG. 2.

In the drawings there is shown spa frame 11 supported by floatable support frame 10. Floatable support frame 10 comprises rigid PVC or fibreglass members 12 in the form of armrests which are desirably UV resistant. Each armrest 13 may include hook shaped connectors 13A to spa frame 11 and a hook shaped retaining strap 13B.

Spa frame 11 comprises rigid PVC tube which provides a peripheral frame 16 interconnected by cross members 18 which are attached to frame 16 by T joints 15. Spa frame 11 is also covered by mesh 17 and is adapted to form a V shape or U shape which would closely contour to the shape of a human body in a reclining or lying position.

Spa frame 11 also includes plugs or seals 20 within the internal bore of the tubular peripheral frame 16. The plugs 20 are designed to prevent a flow through within the frame 16 of water and air. Spa frame 16 and cross members 18 are provided with apertures 19.

Spa frame 11 is attached to water conveying conduits 21A and 21B by elbow joints 22. There is also shown valve assembly 23 interconnecting conduits 21A and 21B. Valve assembly 23 is attached to conduit 24 attached to the outlet pipe of a filter of a swimming pool (not shown).

The valve assembly 23 includes a restricted passageway 28 located adjacent to air conduits 27. As water flows through conduit 24 into the valve housing of valve assembly 23 there is caused a pressure differential across orifice or passageway 28 which causes air to be drawn into the water stream through conduits 27. The water flow may occur in either conduit 21A or 21B dependant upon the position of rotary valve members 25A or 25B.

Figure 4:
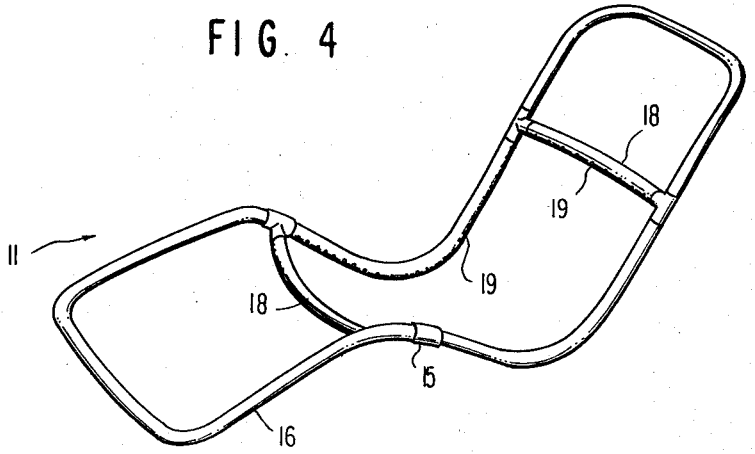
FIG. 4 is a perspective view of the spa frame of FIG. 1.

In operation of the spa of the invention the floatable support frame 10 is placed in a swimming pool (not shown) and spa frame 11 placed therewithin. The hose 24 is attached to valve assembly 23 as shown and the swimming pool filter turned on. Both valve members 25A and 25B are placed in the open position. Water flows across the restricted passageway 28 or "venturi" drawing air into the water stream so that bubbly water or spa water may be directed upon the spine of the body lying on the spa frame or lounger 11 after exiting through apertures 19. The body will have water directed to the top of the spine from four different directions as shown in FIG. 4.

Figure 5:
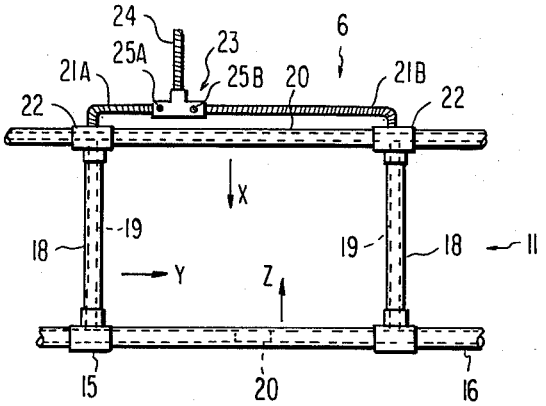
FIG. 5 is a plan view showing the relationship between the abovementioned spa frame, conveying conduit and valve housing of the spa of FIG. 1.
Figure 6:
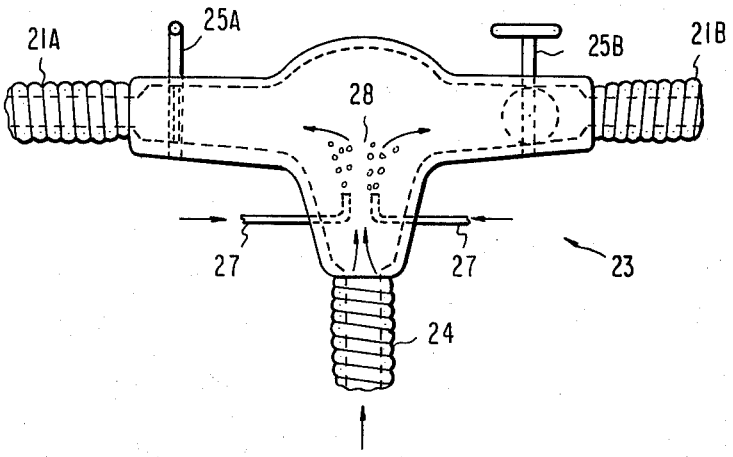
FIG. 6 is a detailed view of the valve assembly shown in FIG. 5.

By selective actuation of valve members 25A or 25B, the spa frame may be propelled in a forward or reverse direction. Thus for example if valve member 25A is turned off and valve member 25B left in the open position, the spa frame will move in one longitudinal direction or in the opposite longitudinal direction if the valve members 25A and 25B are reversed. Actuation of both valve members 25A and 25B will cause the spa frame to adopt a stationary position. In the case of one of the valve members 25A for example being turned off, the water/air mix can only flow in three directions X, Y and Z shown in FIG. 5 as joint members 15 are sealed to frame member 16 and plugs 20 to prevent flow through the remainder of the spa frame.

Figure 7:
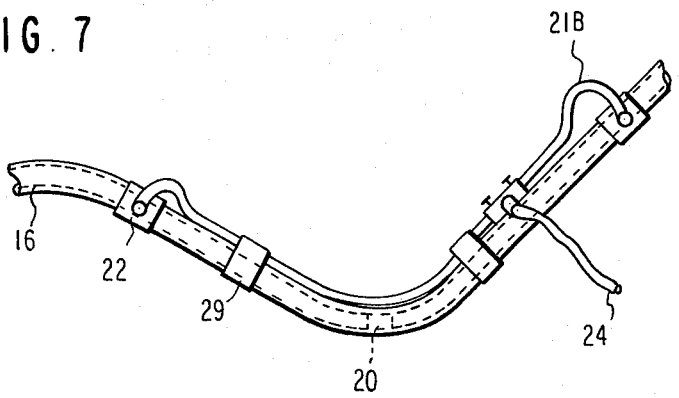
FIG. 7 is a side view of the construction shown in FIG. 5 in the direction of the arrow labelled 6.

In FIG. 7 there are also shown hose clips 29 (omitted for convenience from FIG. 5) attaching hoses 21A or 21B to spa frame 16.

It is believed that the spa frame of the invention will be popular because it can be acquired as an off-the-shelf item and useful for invalids or non-swimmers. The mobility of the preferred form of the floatable spa will also be found to be a decided asset. If a swimming pool contains a plurality of spas in accordance with the invention then they could be used for racing or water polo. The spa of the invention could also be used as a safety toy or life preserver for children.

What is claimed is:

1. A moveable spa which may be used in an in-ground or above-ground water containing structure such as a swimming pool comprising a spa frame having flotation means capable of supporting at least one person and having at least two frame members each provided with a plurality of apertures, a pair of conveying conduits connectable to a water source for conveying water to the apertures in each frame member respectively of said spa frame, a valve housing associated with said conveying conduits and through which said liquid passes from said liquid source including a pair of valve members for controlling the flow of water to each conduit and plug means located in said spa frame for blocking passage of water to separate said two frame members wherein said apertures in each frame member are so oriented and arranged that upon selective actuation of said valve members said spa frame may be propelled in a forward or reverse direction or adopt a stationary position.

2. A moveable spa as set forth in claim 1 further comprising aerating means associated with said valve housing for aerating water as it passes to said apertures from said water source.

3. A moveable spa as set forth in claim 2 wherein said aerating means includes a jet tube having a restricted outlet orifice located within said valve member and at least one air conduit adjacent said jet tube.

4. A moveable spa as set forth in claim 1 wherein said frame is composed of a generally rectangular tubular frame having a contoured intermediate portion with cover means connected to said tubular frame for supporting at least one person and wherein said two frame members are composed of a pair of apaced apart transverse tubular members connected between the sides of said tubular frame with the apertures in each frame member being substantially directed toward the other frame member.

* * * * *